United States Patent [19]

Franek et al.

[11] 4,058,998

[45] Nov. 22, 1977

[54] CONTAINERS

[75] Inventors: Jozef Tadeusz Franek, Chorleywood; Peter Henry Doncaster, Harrow, both of England

[73] Assignee: Metal Box Limited, England

[21] Appl. No.: 719,251

[22] Filed: Aug. 31, 1976

[51] Int. Cl.[2] ..... B21D 19/06

[52] U.S. Cl. ..... 72/84; 72/110; 113/120 AA

[58] Field of Search ..... 113/120 M, 120 V, 120 AA, 113/120 Z; 72/84, 95, 96, 110, 111, 121

[56] References Cited

U.S. PATENT DOCUMENTS

| | | | |
|---|---|---|---|
| 376,167 | 1/1888 | Seymour | 72/121 |
| 2,138,115 | 11/1938 | Nelson | 72/84 |
| 3,648,503 | 3/1972 | Harper | 72/84 |
| 3,847,001 | 11/1974 | Thamasett | 72/96 |

*Primary Examiner*—Lowell A. Larson
*Attorney, Agent, or Firm*—Diller, Brown, Ramik & Wight

[57] ABSTRACT

In a method of forming a neck and flange at the open end of a thin cylindrical metal can body, the can body is held endwise under compression while an axial shortening force and a radial deforming force are applied to the can body sidewalls, by relative axial movement between the can body on the one hand and, on the other hand, an external forming tool and an internal tool edge which are kept at constant axial spacing from each other, so that the neck and flange are formed in free space without any need for internal or external tools shaped to the required profile; any desired shape can be obtained by varying the characteristics of the relative axial and radial motions.

19 Claims, 11 Drawing Figures

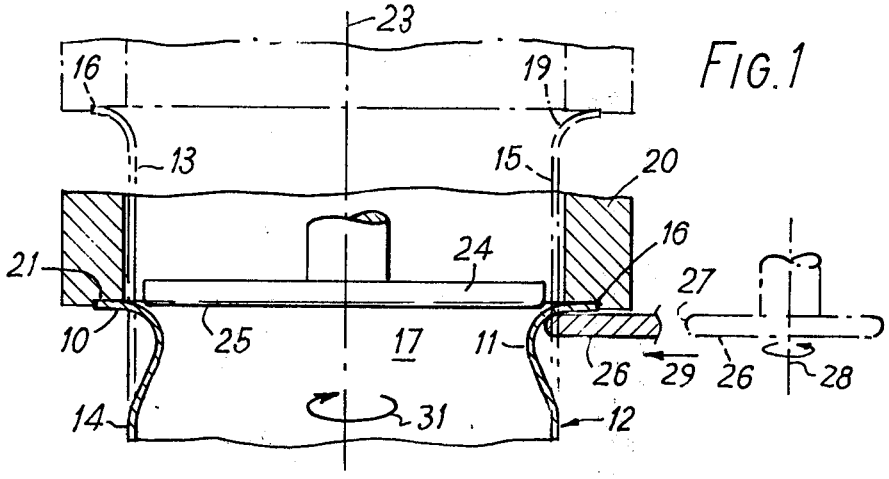
FIG. 1
FIG. 2
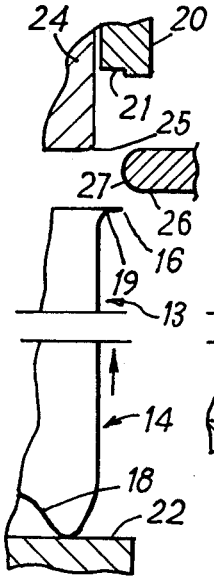
FIG. 3
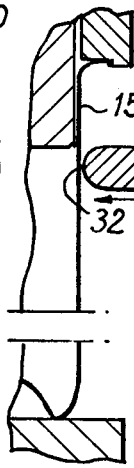
FIG. 4
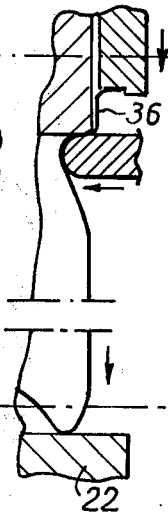
FIG. 5
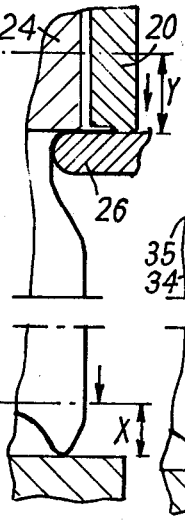
FIG. 6
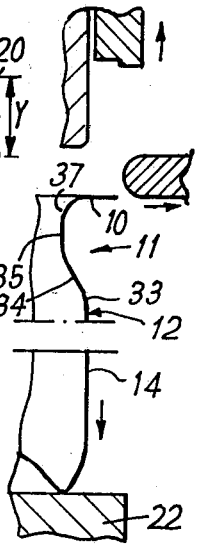
FIG. 8
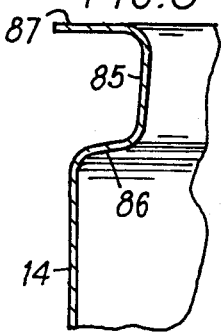
FIG. 9
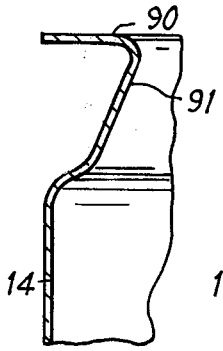
FIG. 10
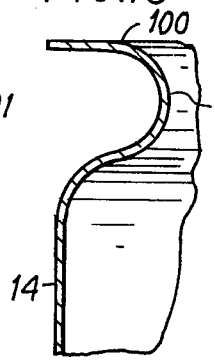
FIG. 11
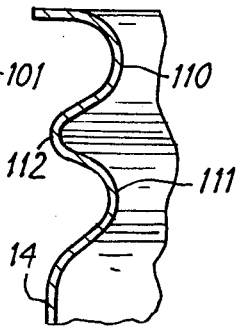

CONTAINERS

This invention relates to containers; to components for such containers in the form of cylindrical one-piece metal can bodies having an open end terminating in an outwardly directed peripheral flange merging with a circumferentially-extending neck portion (the can body being hereinafter referred to as a "can body of the kind hereinbefore specified"); to methods of forming said neck and flange in a can body of the kind hereinbefore specified; and to apparatus for forming the said peripheral flange and neck portion.

The purpose of the peripheral flange is usually to provide an element to which a can end is secured after the can has been filled, this securing being done by deforming the end flange of the can body together with a peripheral flange of the can end so as to form a double seam. The neck enables the flange, and therefore the can end, to be of smaller diameter than if there were no neck; usually the radial depth of the neck is such that the double seam has an external diameter no greater than that of the cylindrical side wall. In some types of metal container, such as those having reclosable lids of the so-called "lever" or "pry-off" type, the member seamed on to the end of the can body is usually a ring in which the lid engages.

The end neck may serve another purpose, which is to provide a convenient means whereby a carrier can engage the container; such carriers are designed to hold a plurality of containers and may be of, for example, paperboard or a flexible plastics material. The type of carrier which engages the neck of a container of the kind with which this specification is concerned usually has a horizontal web in which there are a plurality of holes, the periphery of each hole engaging below the above-mentioned container double end seam so as to support the container wholly or partly thereby. Where the container body is necked, the neck can be so shaped as to provide some measure of support and/or restraint for the carrier web around the hole in the latter, and to assist in locking the container to the web until the user wishes to pull it away from the carrier.

Various methods have been proposed for forming an end neck and flange on a one-piece can body. Some methods involve moulding the neck and/or the flange by means of circumferentially extending moulds. Other methods involve rolling or spinning the neck and/or flange, using an external spinning roll co-operating with an internal member within the can body. In these latter methods as known to us, the can body is supported rigidly by an internal mandrel or the like; the internal member may be a spinning roll or it may be the mandrel which supports the can body. In one such method the neck and flange are formed simultaneously in a can body supported internally and rigidly by a mandrel or chuck of an expaning type, the neck and flange profile being formed by external spinning rolls co-operating with this mandrel.

In another method, the can body is supported internally by an anvil and endwise by a spinning pilot, the neck and flange being formed by a profiled, external spinning roll which deforms the can body into a groove formed on the pilot and anvil, the roll being moved axially of the can body.

In all these previously-proposed methods the final profile of the neck and flange is determined by the profiles of the tool elements used for forming them, in that the tool elements (i.e., moulds, spinning rolls, mandrels, anvil etc. are provided with working surfaces profiled to conform with the required shape of the neck and/or the flange, and the metal of the can body is deformed into conformity with these profiles. It is thus necessary, if a different shape is required, to change the tools so as to provide differently profiled tool elements.

A method such as that mentioned above, in which an expanding mandrel is used enables end flanges and neck portions to be produced reliably and economically even on can bodies made in the thinner and harder metals currently in favour, in particular double-reduced plate which is usually tinplate, but which may, for example, be mild steel or blackplate suitably treated but not necessarily plated with another metal. The present invention is also especially suitable for use with these thinner and harder materials.

According to the invention, in a first aspect thereof, a method is provided for forming a peripheral end flange at an open end of a cylindrical metal can body and a neck merging with said flange, said method including supporting the can body endwise in axial compression, and applying a radial force to the can body by a forming member whilst effecting relative rotation about the axis of the can body between the can body and the forming member, and applying an axial shortening force to the can body so as to deform the can body in free space, whereby progressively to form said metal flange.

Preferably, the method includes the steps of: supporting the can body endwise in axial compression between a bottom support element, coaxially engaging the bottom of the can body and defining a main axis, and an end support member engaging a terminal edge of the body coaxially at said open end, with a pilot element extending coaxially into said body through the end support member, and effecting relative rotation about said main axis between, on the one hand, said can body, bottom support member, end support member and pilot element and, on the other hand, an external forming member whilst effecting relative radial movement between said can body and said forming member, relative axial movement between said can body and forming element, and relative axial movement between said end support member and bottom support element, whereby to apply an axial shortening force to the body and to maintain said endwise support, a constant axial spacing being maintained between a circumferential first tool edge of the pilot element and a second tool edge of the forming member, whereby at least part of said neck and flange are formed in free space by said second tool edge deforming the can body about said first tool edge as fulcrum.

It is implicit in the method of the invention in its preferred form as above defined, that the profiles or shapes of the neck portion and end flange in the finished can body are produced by deforming the metal of the workpiece progressively along the length of the end portion; in effect the second tool edge works its way along the sidewall end portion, forming the required profile therein with the first tool edge engaging the inside of the end portion to provide a fulcrum point for the deformation effected by the second tool edge.

It will be realised that a fundamental feature of the method of the invention as above defined is that, by contrast with previously-proposed methods mentioned hereinbefore, the profile or shape of the neck portion and flange does not rely on the provision of one or more tool surfaces formed with the required profile, because in the present invention the shape does not have to be formed by bringing the material of the workpiece, e.g. by moulding, rolling or spinning, into intimate engagement and therefore conformity with such profiled tool surface or surfaces, but is formed instead, in free space. This does not, however, exclude the possibility, within the scope of the invention, of some portion of the profile being in conformity with a profile of a tool edge. In general, however, by the present invention, the material is wrought in a manner such that it deforms to a shape determined partly by the characteristics of the axial shortening force and radial force, and therefore of the various relative motions, to which the workpiece is subjected, i.e., the shape of the neck portion and end flange, for a workpiece of a particular metallic material having a given thickness, sidewall length and diameter, predetermined by suitable choice of velocity variation and relative timing of the radial motion between the second tool edge and the workpiece in relation to the axial motion between the workpiece and the first and second tool edges.

It will be realised that in its preferred form as above defined the method of the invention, at any instant during the process, provides contact in only three places between the end portion of the workpiece and the tooling used for forming the neck portion and flange, viz. at the terminal edge, to provide radial restraint for the edge and to guide it in its axial motion; at a single point on the inside surface of the end portion, by the first tool edge; and at a single point on the outside surface of the end portion by the second tool edge. It follows that, by varying the characteristics of the relative motions for a given workpiece, the shape or profile to be given to the neck and flange can be changed at will. In practice a wide variety of such shapes can be produced without any need to change parts of the tooling as would be necessary where the required profile depends on tooling parts having particular profiles.

Preferably, the first tool edge is kept stationary and the second tool edge is moved radially with respect to the workpiece, the workpiece being moved axially with respect to the first and second tool edges in a direction such that the axial distance between the latter and the terminal edge of the workpiece decreases to zero.

According to the invention, in a second aspect thereof, apparatus is provided for forming a peripheral end flange at an open end of a cylindrical metal can body and a neck merging with said flange, said apparatus comprising end support means adapted to support said can body coaxially and endwise in axial compression and to apply an axial shortening force thereto, and an external forming member for applying a radial force to the can body, said end support means and forming member being arranged for rotation relative to each other about the axis of the support means.

Preferably the apparatus comprises: a bottom support element for coaxially engaging the bottom of the can body and defining a main axis; an end support member coaxially opposed to the bottom support element, for engaging a terminal edge of the can body at said open end; a pilot member extending through the end support member towards said bottom support element and having a circumferential first tool edge; and an external forming member having a second tool edge facing towards the said main axis and disposed at a constant axial spacing from said first tool edge, said end support member and bottom support element being arranged for axial movement relative to each other whereby to apply an axial shortening force to the can body, and said end support member being arranged for axial movement past the pilot element, and said forming member and end support member being arranged for radial motion relative to each other.

Preferably the bottom support element comprises a lift pad for supporting the end of the workpiece opposite said open end, and the end support member is a limit ring adapted to engage the terminal edge axially and to restrain it radially, said lift pad and limit ring being capable of axial movement independently of each other.

The pilot member is typically a mandrel or chuck having a circular edge to give contact substantially in a single plane transverse to the workpiece axis between said edge (being said first tool edge), and the workpiece.

The forming member is preferably a roller, rotatable about its own axis and having a simple circumferential edge profile defining said second tool edge. This latter edge may be such as to give contact substantially in a single plane, transverse to the workpiece axis, at any instant between said second tool edge and the end portion of the workpiece. There may be two or more of said second tool elements.

The invention also includes within its scope a metal can body of the kind hereinbefore specified, made by a method according to said first aspect of the invention; and also includes within its scope a container comprising a said can body and having an end closure member seamed to the peripheral flange thereof.

Various embodiments of the invention will now be described, by way of example, with reference to the accompanying drawings, in which:

FIG. 1 is a diagrammatic sectional elevation showing part of a can body in association with element of apparatus in a simple embodiment of the invention;

FIGS. 2 to 6 show respectively five stages in the formation of a neck portion and peripheral end flange of a can body, illustrating diagrammatically an example of a method according to the invention;

FIGS. 8 to 11 are sectional scrap elevations showing four examples of neck portions and end flanges which may be formed in the practice of the invention.

Figure 7:
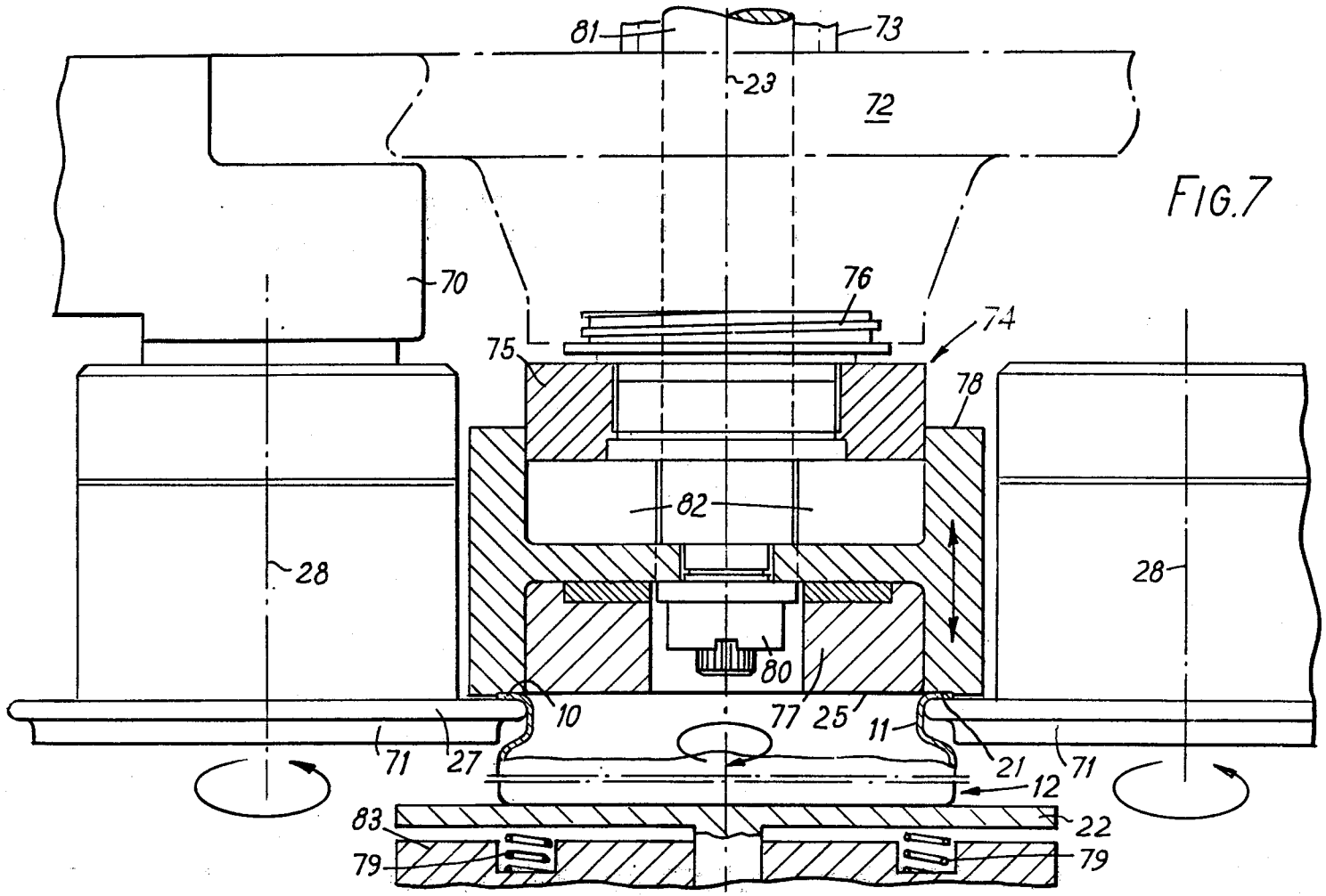
FIG. 7 is a simplified sectional elevation showing parts of apparatus in a further embodiment of the invention.

Referring to FIG. 1, apparatus for forming a peripheral flange 10' and a neck portion 11 of a can body 12 includes end support means (hereinafter described) for supporting coaxially therewith, and in axial compression, a hollow metal workpiece 13 in the form of a cylindrical metal can body. The latter is of the kind comprising a thin cylindrical seamless sidewall 14 having an end portion 15 (shown in chain-dotted lines); the end portion 15 has a terminal edge 16 defining an open end 17 of the workpiece. The workpiece 13 includes an integral bottom wall (not shown in FIG. 1) which may be of any known shape such as the reverse-domed type, part of which can be seen at 18 in FIG. 2. The upper or open end of the cylindrical sidewall 14 of the workpiece 13 is in this example slightly flared in the end portion 15 to define a small initial flange 19. The workpiece 13 is preferably of double-reduced tinplate or chemically-treated mild steel or blackplate.

The support means comprises an end support member in the form of a limit ring 20 having at its lower end an annular rebate 21 for engaging the terminal edge 16 and the flange 10, and a bottom support member in the form of a lift pad 22, not shown in FIG. 1 but provided as in the arrangement of FIG. 2 to support the bottom wall 18 of the workpiece from below. The lift pad 22 and the limit ring 20 are arranged for controlled movement in the direction of the axis 23 of the workpiece 13, independently of each other in a manner which will become clearer from the description hereinafter with reference to FIGS. 2 to 6.

The apparatus also includes a pilot member in the form of the mandrel or chuck 24 extending through the limit ring 20, and within the hollow workpiece 13, towards the lift pad 22. In this example the chuck 24 consists of a simple disc having a first peripheral tool edge 25 which is slightly radiused; and a forming member in the form of a necking roller 26 having a second tool edge in the form of a simple radiused circumferential edge profile 27, at a constant axial spacing from the tool edge 25. The necking roller 26 is rotatable about its own axis 28 in known manner, and is also arranged for relative radial motion between itself and the main axis 23 which is common to the workpiece 13, the limit ring 20 and the lift pad 22. This relative motion is obtained by controlled radial movement of the roller 26 as indicated by the arrow 29.

The limit ring 20 and the lift pad, the workpiece 13 and chuck 24 are rotatable together about the axis 23.

The operation of the apparatus will be more clearly understood by reference to FIGS. 2 to 6. The workpiece 13 is supported on the lift pad 22 and raised thereby (FIG. 2) until the terminal edge 16 of the workpiece engages in the limit ring rebate 21 as seen in FIG. 3. The limit ring 20 at this stage is at its uppermost position, and the workpiece 13 is out of contact with the chuck 24.

The workpiece 13 is now supported coaxially, in axial compression, by the lift pad 22 and limit ring 20; the latter provides radial restraint for the terminal edge 16. It will also be seen that the chuck 24 lies internally of the workpiece 13 and that the sidewall 14 of the latter lies between the chuck 24 and the necking roller 26 outside the workpiece.

With the lift pad 22, limit ring 20, chuck 24 and workpiece 13 rotating as a unit (as indicated by the arrow 31 in FIG. 1), the lift pad 22 and limit ring 20 are moved downwards as indicated by the vertical arrows in FIGS. 4 to 6, so moving the workpiece 13 down with them relative to the tool edges 25 and 27.

During this axial motion the necking roller 26, rotating continuously about its own axis, is moved radially. These axial (vertical) and radial (horizontal) movements of the workpiece 13 and roller 26 respectively are timed so that a point 32 (FIG. 3) on the roller edge surface 27 first makes contact with the sidewall 14 of the workpiece 13 just where the lower extremity 33 (FIG. 6) of the neck portion 11 is to be.

As the vertical downward movement of the workpiece continues, further horizontal movement of the necking roller 26 causes the metal of the workpiece end portion 15 to be deformed (FIG. 4) in free space by co-operation between the tool edge 27 of the roller and the tool edge 25 of the chuck, the edge 25 engaging the internal surface of the workpiece in a common radial (vertical) plane with the point of contact 32 between the edge 27 and the outer surface of the workpiece. The tool edge 25 serves as a fulcrum for the controlled deformation of the metal in free space, to form a frustoconical neck profile 34. If the radial movement of the necking roller 26 is now stopped whilst axial motion of the workpiece 13 continues, a cylindrical neck profile 35 will be formed (FIG. 5) above the profile 34.

FIG. 5 represents the end of the forming operation, the limit ring 20 having reached its lowest position and the whole of the end portion 15 of the workpiece 13 having been formed into the neck portion 11 and peripheral end flange 10, the top surface of the latter being defined by the position of the internal tool edge 25.

It will be seen from the foregoing that the limit ring 20 serves not only to restrain the terminal edge 16 in the radial direction and apply an axial shortening force thereto, but also to guide it in its axial motion so as to keep the still-undeformed part of the workpiece (viz. 36 in FIG. 4) steady in its initial state. It will be appreciated that, in order to achieve this, the provision of the initial flange 19 is desirable, though not necessarily required in all cases.

Whilst the lift pad 22 moves steadily downwards through a distance X during the forming operation, the limit ring 20 moves downwards through a distance Y which is greater than the distance X. The velocity characteristic of the movement of the limit ring 20 is determined by the rate at which metal is drawn away axially therefrom, and will vary according to the neck and flange profile required. It will be understood that this variation can be predetermined, and closely controlled by any one of a number of known techniques for the control of tools. In the same way the predetermined characteristics of the radial motion of the necking roller 26 can be closely controlled. It is of course possible to provide a characteristic motion of the lift pad 22 such that it does not move at substantially constant velocity. By arranging the vertical and horizontal movements respectively of the lift pad 22 and limit ring 20 and of the roller 26 to have predetermined velocity characteristics and by timing these movements in a predetermined manner relative to each other, any desired neck and flange profile can be obtained.

In this connection it is to be noted that the chuck 24, limit ring 20 annd necking roller 26 constitute a tool set which may readily be fitted as a simple modification to a standard machine of a known type for necking can bodies by spinning, or for seaming end members to can bodies. Such a machine includes the lift pad 22, together with drives for rotating the seaming roll and for moving it radially; for rotating the chuck and lift pad; for moving the lift pad up and down; and for moving the chuck up and down. Since such machines are well known in the art, they do not need to be described in detail here; it will readily be appreciated that the drive for moving the chuck up and down may be coupled instead to the limit ring 20 so as to effect vertical movement of the latter instead of the chuck 24. Coupling these various drives together so as to control the characteristics as discussed above may be performed in any known manner. There may, for example, be provided three timed cams controlling respectively the vertical movements of the lift pad and of the limit ring, and the radial or horizontal movement of the necking roller, all the cams being driven from a constant-speed motor. Alternatively a simple electrical control system of the numerical, magnetic, tape or "peg-board" types may be provided to control the various drives; these systems have the advantage of being very readily re-programmable to a new profile of neck and flange.

It will be appreciated that, as discussed earlier herein, it is the characteristics of the various relative motions of the tool elements 20, 22, 25, 27, together with the inherent characteristics of the material and dimensions of the workpiece 13 itself, that determine the final profile of the neck portion 11 and end flange 10. The workpiece makes no contact with the chuck 24 except at the tool edge 25, although the forming of the radiused portion 37 joining the flange 10 to the cylindrical upper part 35 of the neck portion 11 is in this example assisted by the provision of the radiused tool edge 27 of the necking roller 26.

FIG. 6 shows the limit ring 20 returned to its upper position and the necking roller 26 to its disengaged position, whilst the lift pad 22 descends to enable the finished can body 12 to be removed.

Referring now to FIG. 7, a conventional spin necking or can end seaming machine, having the various drives discussed hereinabove, has a pair of arms 70 each adapted to carry a spinning or necking roller 71. A necking head base member 72 which is rotatable by a tubular spinning or necking spindle 73 (the member 72 and spindle 73 being indicated by chain-dotted lines), has a necking and flanging tool 74 secured thereto. The tool 74 is adapted to the method described above with reference to FIGS. 1 to 6 and comprises essentially a ring 75, secured to the member 72 by a hollow nut 76; a chuck 77 secured by means not shown to the ring 75; and a limit ring 78 which is mounted coaxially around, and for axial movement with respect to the ring 75 and chuck 77. The limit ring 78 is secured by a nut 80 to a vertical actuating rod 81 which is movable (by suitable conventional means, not shown) axially through the member 72 and ring 75. The limit ring 78 is constrained against rotation relative to the ring 75 by webs 82 of the latter engaging slots (not shown) in the limit ring, but is rotatable with the actuating rod 81, which extends up through the necking spindle 73. Thus the whole tool 74, with the base member 72, is rotatable by the necking spindle 73, but the limit ring 78 is also movable axially by the actuating rod 81, which gives full positive control of the movement of the limit ring 78. The lift pad 22 is supported on a base member 83 by compression springs 79. The base member 83 is movable up and down as explained hereinbefore with reference to FIGS. 2 to 6. The springs 79 serve to pre-load the workpiece against the limit ring 78 by an amount such as to induce a friction torque greater than the frictional torque induced by resistance of the workpiece to the necking operation.

Operation of the apparatus, comprising the machine having the necking tool 74 and rollers 71 of FIG. 7, is generally as in the embodiment described already with reference to FIGS. 1 to 6. The use of two necking rollers is preferred.

Referring to FIGS. 8 to 11, these show four only out of many possible profiles of neck portions and end flange which may be obtained by methods and apparatus such as those described above. A fifth such profile is that shown in FIG. 6. In the profile shown in FIG. 8, the neck portion consists of a cylindrical portion 85 joined to the main part of the can body sidewall 14 by a generally-radial portion 86. The outside diameter of the end flange 87 is substantially equal to that of the sidewall 14.

The profile shown in FIG. 9 enables an end closure member of substantially smaller diameter than that of the sidewall 14 to be secured to the can body by means of the peripheral end flange 90, the latter being joined to the sidewall 14 through a relatively long frusto-conical neck portion 91.

FIG. 10 shows a more conventional profile in which a peripheral end flange 100 is a continuation of a neck 101 having a C-shaped cross-section.

Finally, FIG. 11 illustrates one example of a profile in which the neck portion comprises more than one neck 110, 111, joined by a circumferential bead 112.

We claim:

1. A method of forming a cylindrical metal can body of the type having an open end with a peripheral end flange about the open end of the can body and a neck portion of reduced diameter merging with said flange, said method comprising the steps of supporting the can body in axial compression and then while so holding the can body in axial compression applying a radial force inwardly on the can body deforming the can body radially inwardly adjacent the can body open end to thereby simultaneously inwardly neck the can body and axially shorten the can body.

2. A method according to claim 1, wherein the can body is compressively supported endwise between a can bottom support element and an axial thrust member with a terminal edge of said body, defining said open end engaging the thrust member, effecting relative axial movement between the support element and the thrust member in a direction towards one another to maintain said compressive endwise support as the can body is shortened during application of said radial force.

3. A method according to claim 1, wherein a pilot element having a circumferential first tool edge is disposed coaxially within the can body, and said radial force being applied by a second tool edge spaced from said first tool edge by a distance having a constant axial component with the first tool edge acting as a fulcrum for the deformation of the can body.

4. A method according to claim 3, wherein the second tool edge is moved radially with respect to the can body to apply said radial force.

5. A method according to claim 3, wherein the can body, while supported in said axial compression, is subjected to relative axial movement between itself and said tool edges, whereby the neck portion and flange are formed progressively towards said terminal edge.

6. A method of forming a cylindrical metal can body having an open end with a peripheral end flange about the open end of said body and a neck portion merging with the flange, said method comprises the steps of: supporting the can body axially between a can bottom support element and an axial thrust member with a terminal edge portion of the can body at its open end engaging the thrust member, positioning a pilot element having a circumferential first tool edge disposed with the first tool edge coaxially within the can body; providing a forming element having a second tool edge, radially inwardly engaging the exterior of the can body with the second tool edge and effecting relative axial movement between, on the one hand, the can body and support element and, on the other hand, the pilot element and the forming element having the second tool edge engaging the can body while effecting relative radial movement between the can body and the second tool edge and relative axial movement between said support element and thrust member such as to maintain the can body under continuous compression while shortening it, whereby said flange and said neck are formed on the can body in free space by the second tool edge with the first tool edge acting as a fulcrum for deforming the can body between the trust member and the forming element, and the first and second tool edges being maintained in respective planes at a constant axial spacing from each other.

7. A method according to claim 6, wherein the forming element is a roller with the second tool edge being formed circumferentially thereof, and the roller being rotated about its own axis during formation of the neck and the flange.

8. A method according to claim 6, wherein the can body is rotated about its own axis by simultaneous rotation of the support element and the thrust member.

9. A method according to claim 6, wherein the first and second tool edges are maintained in fixed axial planes while the can body, the support member and the thrust member are moved axially with respect thereto.

10. Apparatus for forming a cylindrical can body having a bottom end and an open end with a peripheral end flange about the open end of the can body and a neck portion merging with the flange, said apparatus including opposed first and second axial support means defining a main axis and being adapted for respectively supporting the bottom end and engaging a terminal edge portion of the open end of the can body and maintaining the can body in axial compression thereby, inward radial force applying means adjacent said second axial support means and being movable radially with respect to said main axis, and a pilot element extending coaxially through said second axial support means towards said first axial support means and having a circumferential first tool edge, said inward radial force applying means having a second tool edge at a fixed axial spacing from and axially nearer to said first axial support means than said first tool edge, and first and second axial support means being arranged for axial movement relative to said tool edges and relative to each other such as to shorten the axial distance between said first and second axial support means.

11. Apparatus for forming a cylindrical metal can body having an open end with a peripheral end flange about the open end of the can body and a neck portion merging with the flange, said apparatus comprising: a can bottom support element defining a main axis; an axial thrust member coaxial with but spaced axially from said support element and adapted to engage endwise a terminal edge of the can body at the open end thereof; a pilot element extending coaxially through said thrust member towards said support element and having a circumferential first tool edge; and a forming element having a second tool edge at a fixed axial spacing from and axially nearer to the support element than said first tool edge, said second tool edge being offset from and facing said main axis, said support element and thrust member being arranged for axial approaching movement relative to each other, said thrust member and pilot element being arranged for radial movement relative to each other, and said forming element and pilot element being arranged for radial movement relative to each other.

12. Apparatus according to claim 11, wherein said thrust member comprises a limit ring.

13. Apparatus according to claim 12, wherein said limit ring has an annular rebate, for engaging said terminal edge, in the inner circumference of its end nearest the support element.

14. Apparatus according to claim 11, wherein said forming element is a roller rotatable about its own axis, said second edge being formed circumferentially thereof.

15. Apparatus according to claim 14, including a plurality of said rollers spaced apart around said main axis.

16. Apparatus according to claim 11, wherein the thrust member and support element are movable axially with respect to the pilot element, said first tool edge being in a fixed radial plane.

17. Apparatus according to claim 11, wherein the thrust member, pilot element and support element are mounted for simultaneous rotation about said main axis.

18. Apparatus according to claim 11, wherein said forming element has a simple curved edge profile defining said second tool edge.

19. A method forming a cylindrical metal can body having an open end with a peripheral end flange about the open end and a neck portion merging with the flange, said method comprising the steps of providing a can body having an initial flange, endwise clamping the can body between two support members to axially compress the can body, simultaneously rotating the two support members and the can body about a fixed axis, engaging the can body externally with a radially inwardly directed force applying member spaced from but adjacent to the initial flange to radially inwardly neck the can body, and then while maintaining the axially compressive force on the can body effecting relative axial movement of the can body and the force applying member in a direction to effect relative movement of the initial flange towards the force applying member and to increase the axial extent of the neck while foreshortening the can body followed by the reforming of the flange.

* * * * *